US006047931A

United States Patent [19]

Flanagan et al.

[11] Patent Number: 6,047,931

[45] Date of Patent: Apr. 11, 2000

[54] BAMBOO SUPPORT BASE ASSEMBLED FROM HELICAL STRUCTURE

[75] Inventors: David B. Flanagan, Jamaica Plain, Mass.; Robert H. Gow, Houston, Tex.

[73] Assignees: Bamboo Fencer, Inc., Jamaica Plain, Mass.; Xixim Del Sureste Sa De C.V., Houston, Tex.

[21] Appl. No.: 09/250,229

[22] Filed: Feb. 15, 1999

[51] Int. Cl.[7] ..... A47G 23/02

[52] U.S. Cl. ..... 248/127; 248/146

[58] Field of Search ..... 248/127, 146, 248/150; 108/115, 150

[56] References Cited

U.S. PATENT DOCUMENTS

D. 384,222 9/1997 Cheng ..... 248/127 X 4,701,065 10/1987 Orosa ..... 403/263

5,495,629 3/1996 Husler ..... 5/236.1

5,505,238 4/1996 Fujii et al. ..... 144/2 R

*Primary Examiner*—Ramon O. Ramirez

*Attorney, Agent, or Firm*—Baker Botts L.L.P.

[57] ABSTRACT

A support base made of bamboo culms is provided. Culms forming legs for support are cut to form a flat surface on the ends of culms contacting a floor. Holes are drilled through the culms at selected distances and angles so as to allow the culms to form a support having a waist. The structure is supported by wires, cord, rope or similar members through the holes that are placed in tension when a load is applied to the base. Spacers, preferably of bamboo culms having a smaller diameter than the legs, are placed over the wires between legs of the base.

7 Claims, 6 Drawing Sheets

BAMBOO SUPPORT BASE ASSEMBLED FROM HELICAL STRUCTURE

FIELD OF THE INVENTION

This invention pertains to a support base made from bamboo that may be used in furniture. More particularly, bamboo culms are cut and drilled and held together by wire so as to form a helical structure that can be assembled to form a base or support.

BACKGROUND OF THE INVENTION

Clumping bamboo can be widely grown in tropical areas of the world. The structure of such bamboo is strikingly different from that of many other plants. The trunk of the plant is called the "culm," and multiple culms grow from each clump. A culm may grow to be several tens of feet in length in some varieties of bamboo. The diameter of a culm varies from a maximum near the ground to a small value near the upper tip. The range of diameters of culms available from bamboo plants varies from a fraction of an inch to several inches. Each culm is covered with a tough, hard outer skin, giving the culm high mechanical strength.

Once established, bamboo replenishes itself very rapidly. Therefore, fully developed bamboo culms can be cut every two to three years. In even less time, branches in the 0.5- to 1.5-inch diameter can be cut from immature clumps.

It is known to construct furniture from bamboo. U.S. Pat. No. 4,701,065 discloses knockdown furniture and structural components made from bamboo. Bamboo pieces are cut into predetermined lengths to form legs, rails and couplings for furniture. The legs and rails are provided with holes and fitted with female fittings. The coupling is fitted with a dowel having blind threaded holes through which male fittings can be connected.

Since bamboo is more favorably grown in regions which are remote from major markets, the cost of transporting bamboo furniture or articles to market becomes a significant cost of the article. Costs of transport by ship are usually determined by the volume of the article. Therefore, ability to pack bamboo furniture in a form which can be easily assembled to the bamboo product after shipment and which occupies minimum volume during shipment is important in determining retail cost of the article.

There is a need for support bases for pieces of furniture such as tables, stools and chairs, or any other support utilizing bamboo pieces. The support bases should be easily assembled from a structure that can be packed in a relatively flat and compact configuration for shipping.

SUMMARY OF THE INVENTION

A support made from bamboo culms is provided. The culms are drilled for wires to encircle the structure and be joined at ends of the wires. At least two wires encircle the structure at positions such that a waist, or minimum area, is formed. One wire may be at the waist and extend from one culm to the next with no spacer between culms. For wires encircling the structure not at the waist, spacers are placed between the culms.

The support is made by drilling holes in bamboo culms such that a wire members placed in the culms form a circular or elliptical cross-section while passing through the culms. Before the wire members are joined at the ends, they form a helical shape that is particularly appropriate for shipment of the structure.

DESCRIPTION OF PREFERRED EMBODIMENTS

Figure 1A:
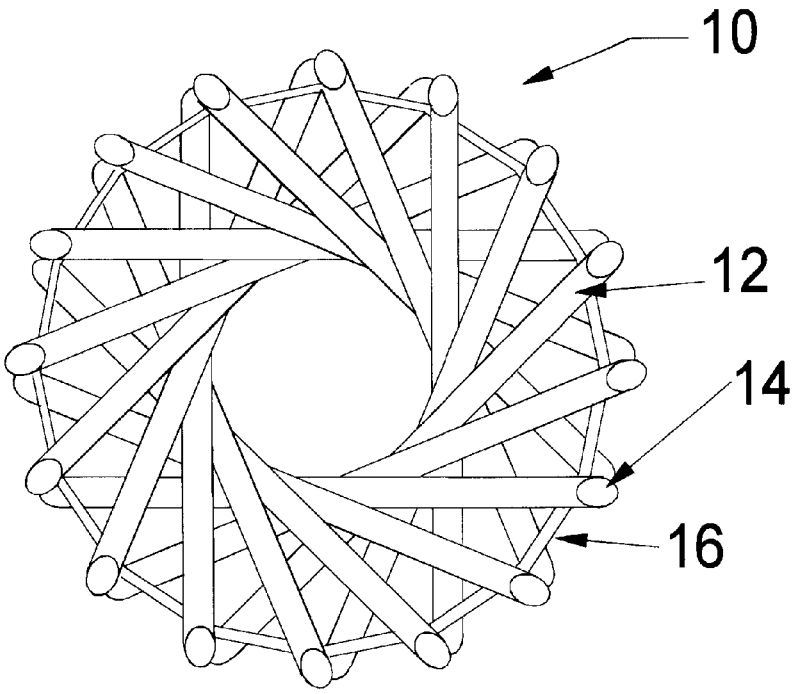
FIGS. 1A and 1B show top and side view drawings of one embodiment of the support base of this invention.

Referring to FIG. 1A, one embodiment of support base 10 of this invention is shown. Base 10 is made up of bamboo culms 12 that have been cut to a selected length. Preferably, each end of each culm has been cut at a selected angle with respect to the longitudinal axis of the culms. This angle, called $\alpha$, is selected such that both ends of each culm will form a surface in a horizontal plane. The lower horizontal plane will be the surface on which the support sits and the upper plane will be in contact with a top of the furniture or any other object to be supported. Alternatively, the upper end of each culm may be cut an any angle to support another part of furniture (or other object) or both ends may be perpendicular to the longitudinal axis of the culm. When each end is cut to an angle not perpendicular to the axis of the culm, the end then forms elliptical surface 14, FIG. 1A. Individual culms are separated by top spacers 16, which preferably are bamboo culms but may be made from metal, plastic or other materials in the form of a hollow elongated structure. Spacers are held in place by wire (not shown) passing through the center of the spacers.

Figure 1B:
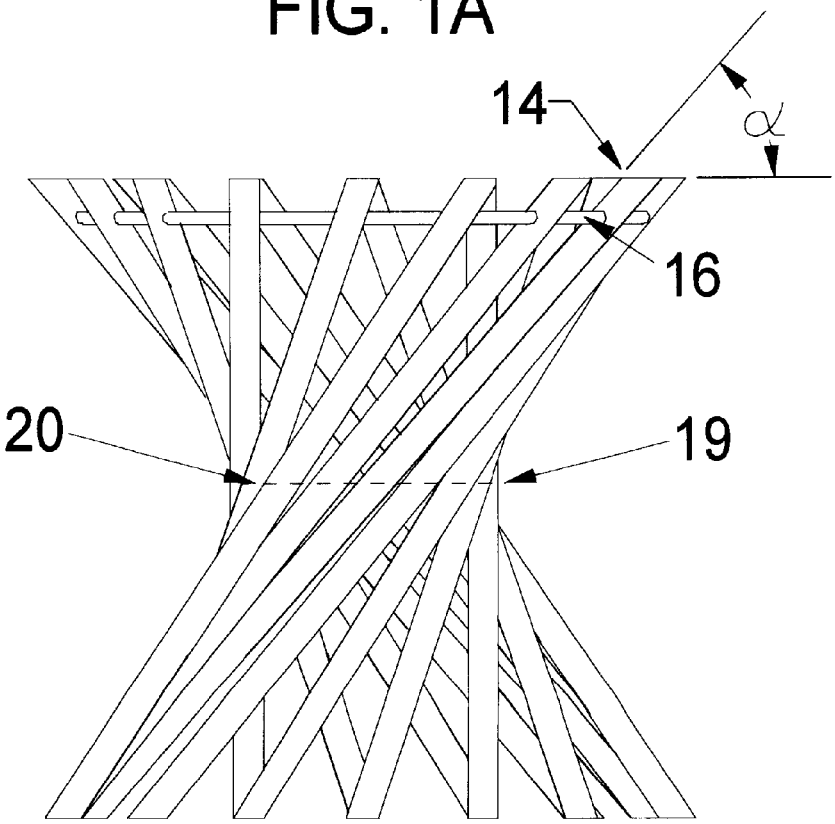
Figure 2:
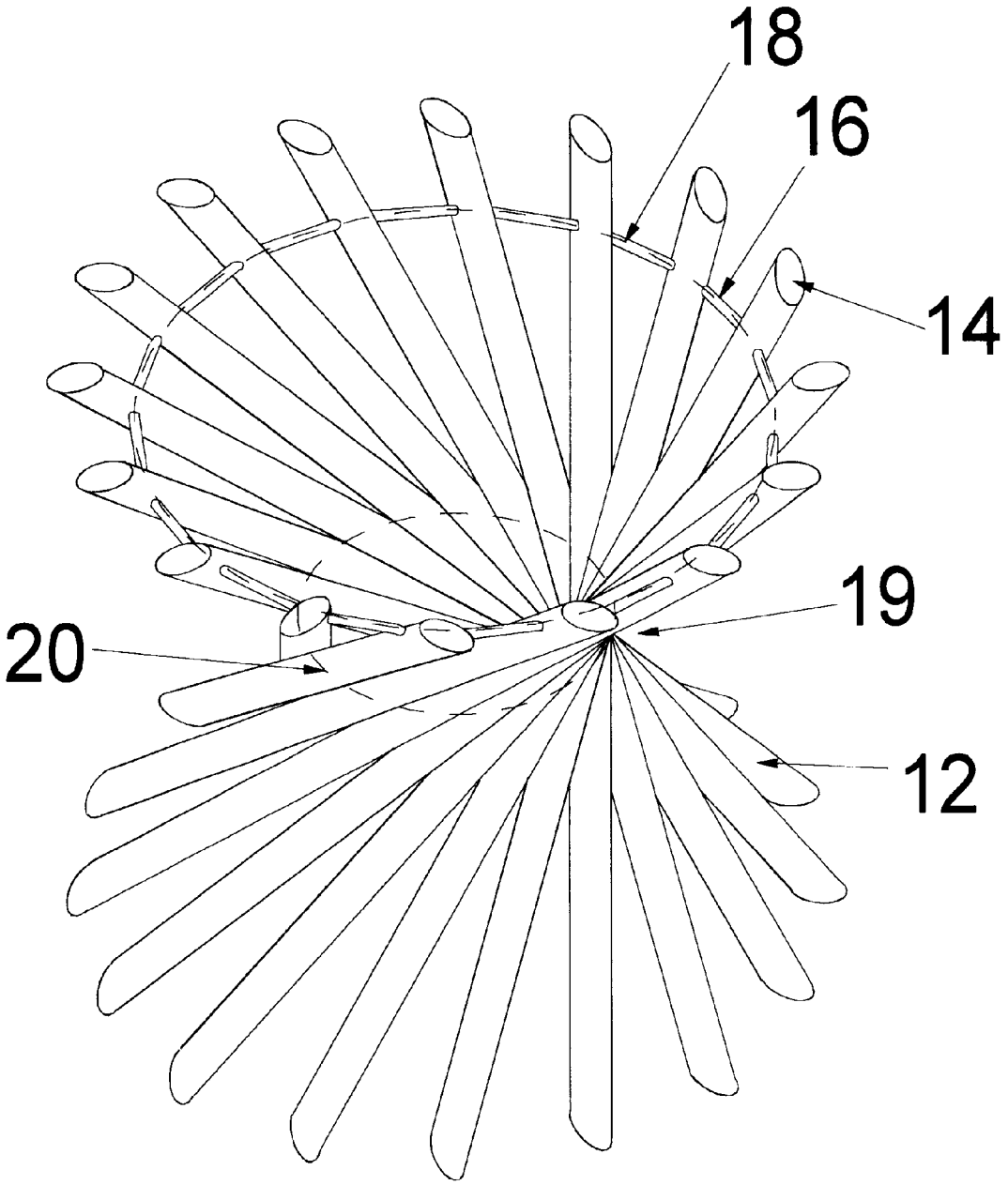
FIG. 2 shows an isometric drawing of one embodiment of the support base of this invention.

FIG. 1B shows a side view of support base 10 including waist 19, which is the narrowest cross section of the structure, and waist wire 20. FIG. 2 shows an isometric drawing of the structure with waist wire 20 shown at waist 19. No spacers are shown at the waist, although spacers can be used with any of the wires. Often a wire will be placed at the waist of a support base, although it is not essential as long as at least two wires extend completely around the structure. Also shown is wire 18 passing through top spacers 16. Additional wires may also be placed through culms, with or without spacers, in horizontal or in non-horizontal planes, each wire penetrating the bamboo culms. The hole-size in spacers is selected to accommodate the desired wire diameter and the length is cut to fit against the culms or legs of the base. Spacers are normally of equal length in each horizontal plane of the support.

The wires supporting the structure must be joined at ends to form a closed loop in a horizontal plane to form the support base. Preferably the wires are joined so that they may be opened at the ends but such that the bamboo culms remain held in place by wires passing through holes in the individual culms. Alternatively, the wires may be permanently joined at ends such as by welding or brazing, but this permanent joining will preferably occur only after shipment of the structure that will form the support base.

Figure 3A:
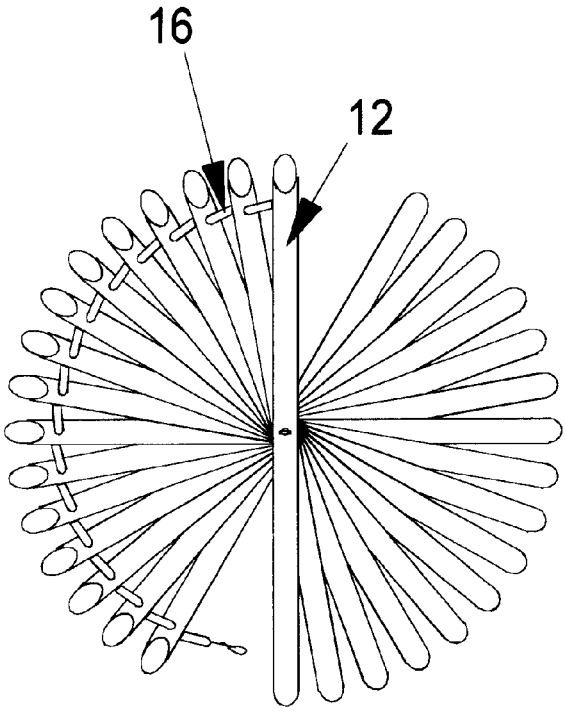
FIGS. 3A and 3B show a drawing of the structure of this invention when ends of wires are not joined.
Figure 3B:
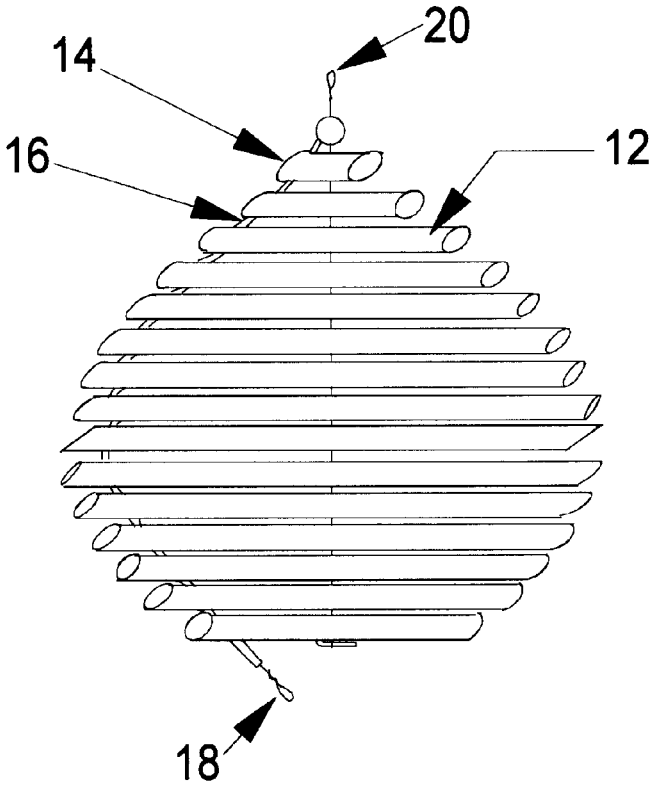

FIG. 3A shows the top view and FIG. 3B shows the side view of the support base of FIG. 1 when the support wires are separated at the ends and the structure extended into a form allowing the nesting of units for shipment. Waist wire 20 is extended straight and top spacers 16 containing top wire 18 now cause ends of culms 12 to form a double helix.

This form has a very significant advantage in shipment of the furniture base of this invention. It allows units to be stacked together, thereby reducing the volume and the shipping cost of a furniture base. In this embodiment of the invention, a user or dealer may then assemble the units after shipment by joining the ends of the wires to form a support base which may be used for furniture such as end tables, coffee tables, game tables, dining tables, stools, bar stools, chairs and other items of furniture. Alternatively, the end of the wires are joined before shipment from locations where shipping costs are not excessive.

Figure 4A:
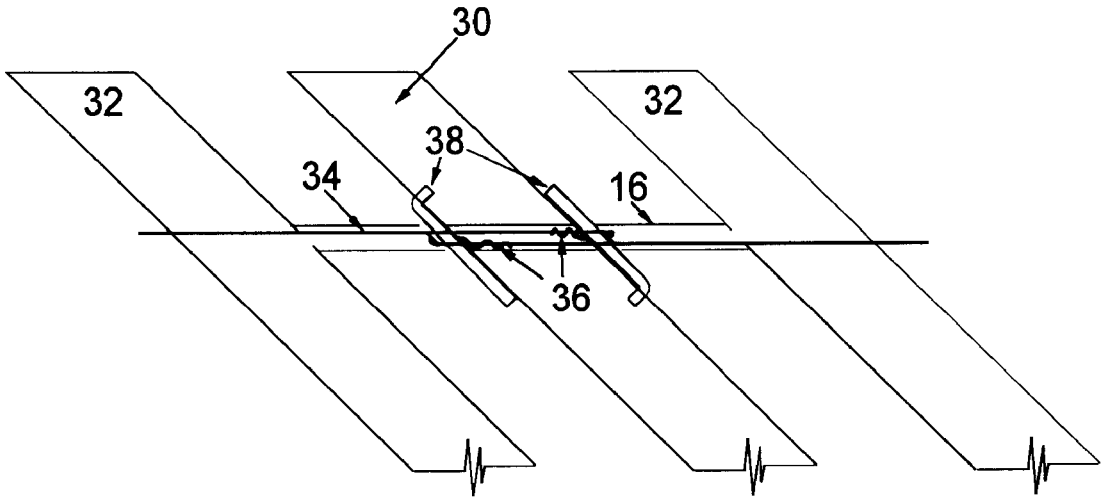
FIGS. 4A and 4B show one embodiment of the means for connecting supporting wires in the furniture of this invention.
Figure 4B:
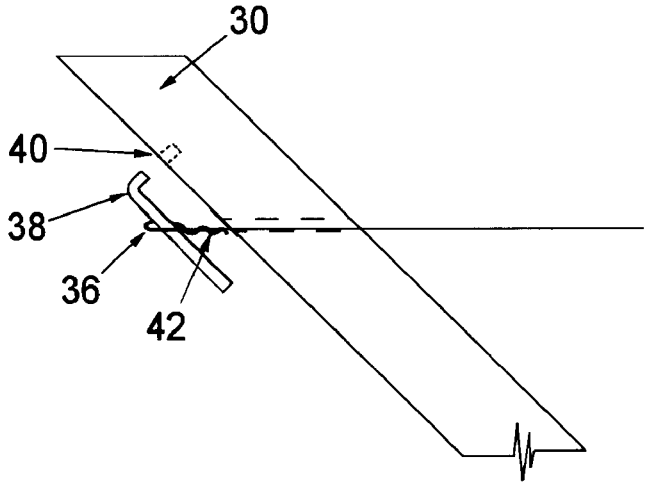

Since in a preferred embodiment the furniture base is to be shipped as nested helixes and later be formed by joining the ends of the support wire, the method for joining the ends of wires is important. FIG. 4A illustrates a preferred embodiment for joining the support wires. Ends of a wire are preferably joined within a selected bamboo culm, which is called a "connecting leg." Connecting leg 30 is separated from adjoining culms such as 32 by spacers 16. Wire 34 passes through other bamboo culms and the center of spacers 16 and forms loops 36 at the ends of the wire. Wire 34 and loops 36 are extended outside culm 30 far enough to insert L-shaped pins 38 through loops 36, as shown in FIG. 4B. Preferably, loops 36 have been made stronger by welding or soldering wire 34 at twist 42. The short end of pins 38 is then inserted in hole 40 to prevent pin 38 falling out or twisting within loops 36. Alternatively, loops 36 can be overlapped and joined with a machine screw and nut and hidden within connecting leg 30, or wire 34 can encircle connecting leg 30 and be joined to form a loop around the leg.

Wire 34 is preferably copper-clad steel wire having a size in the range from about 18 gauge to about 10 gauge. Alternatively, other metal wire, woven plastic cord, woven natural fiber cord, monofilament plastic or other materials capable of forming a strong loop at the ends and having sufficient tensile strength may be used. All such material is included within the term "wire" for purposes of this document. Pin 38 is preferably made from brass, but other metals may be used.

The number of bamboo culms used in the base of this invention may vary from three to as many as sixty or more. The culms may vary in diameter within a base. The process for constructing a standard vertical axis furniture base of this invention is as follows. Bamboo culms are cut to the proper length and an angular cut is preferably made on each end of the culms for the angle at which they are to intersect the floor and any top piece. A commonly used angle is 45°, however smaller angles may be used for a furniture base that is not to extend over a large area, such as a bar stool, or larger angles may be used for relatively low pieces of furniture, such as coffee tables. The angles are cut uniformly on the ends of culms that are to be used. Holes in culms for all wires around the structure are normally drilled to provide that the wire will extend along a line in a horizontal plane.

All culms in the structure do not intersect at the waist of the support base, but are offset from the vertical center line of the structure a distance at least sufficient to allow the culms to pass other culms at the waist. Referring to FIG. 1, offset distance, R, is indicated. The minimum value of R, $R_m$, under these conditions may be estimated by considering the minimum circumference of the waist as being the sum of the distances formed by a waist wire through drilled holes at the waist. For example, if 12 culms are used and the average diameter of the culms on the waist wire is 1 inch, $2\pi R_m = 12/\sin\alpha$; $R_m$=approximately 2.7 inches when $\alpha=45°$.

Holes for the wire at the waist of a support base will be in a horizontal plane, and, therefore, will be drilled in a plane parallel to the ends of the culms and in the direction of the major axis formed by the ellipse at each end of a culm. Holes for wires to be placed above or below the waist should be drilled at an angle, θ, with respect to that plane. The value of θ can be estimated as follows: $\theta=R/L\cos\alpha$, where R is the offset distance and L is the length along the longitudinal axis of the culms between the waist hole and the holes for a top or bottom wire. For example, is R is desired to be 5 inches and top holes are to be placed 18 inches from the waist, $\theta=5/18\cos\alpha$. If $\alpha=45°$, $\theta=22°$. For the holes drilled near the first end of a culm, this angle is positive. For the holes drilled near the second end of the culm, which must be on the opposite side of the waist of the structure, this angle is negative.

Figure 5A:
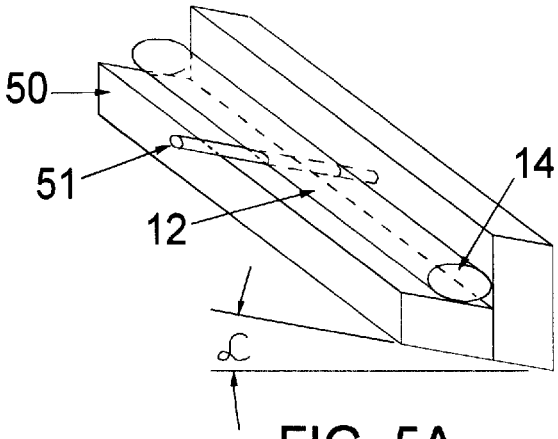
FIGS. 5A, 5B and 5C illustrate a method for drilling holes for wires in the bamboo culms.
Figure 5B:
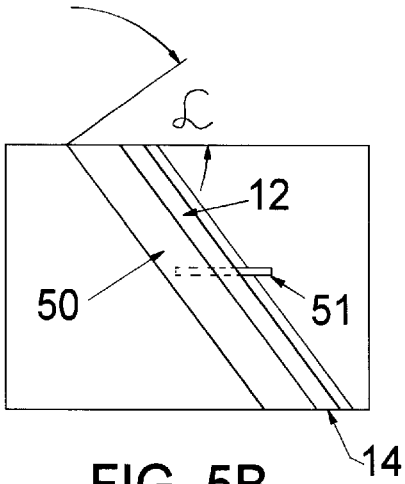
Figure 5C:
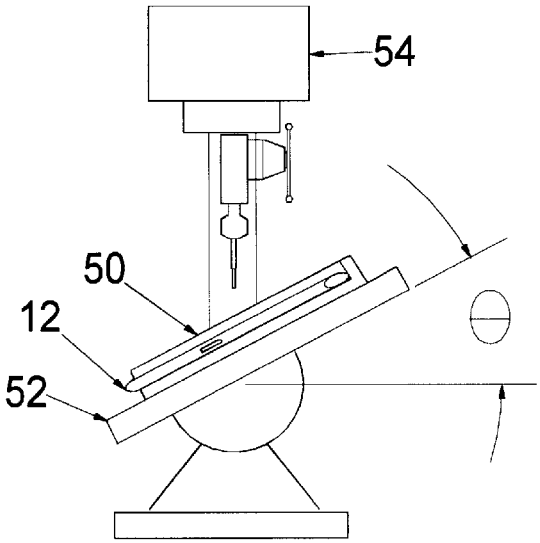

FIG. 5 illustrates how ends of the culms are to be formed and how holes may be formed in the culms. First, a hole is drilled in a culm for the waist wire. This hole is drilled at angle α with respect to the axis of the culm. FIG. 5A shows an isometric drawing of culm 12 that has been placed in a jig or miter box 50 having pin 51 which protrudes at angle α from the jig and extends through a hole previously drilled in culm 12 at angle α with respect to the axis of the culm. Angle α will often be in the range of 45°. With the culm held in place with pin 51, the ends of culm 12 are then cut at angle α using the ends of the jig or miter box, as shown in the top view drawing of FIG. 5B. This forms elliptical surface 14 at each end of culm 12. In FIG. 5C, culm 12 and miter box 50 have been placed on bed plate 52 of drill press 54. The major axis of the ellipse 14 is parallel to bed plate 52 and is still supported in jig/miter box 50. Bed plate 52 has been tilted at angle θ for drilling of a hole for wire that is to be placed through culm 12 at distance L from the center hole, where θ has been estimated from equations above. Although drilling according to a simple drill press and jig is described above, it should be understood that a computer-driven drill press capable of three dimensional work may be used. Also, the support base of this invention may be represented using computer-aided design software and the angles and distances read directly from the graphic display of the software.

After drilling holes in the culms at the prescribed angle θ one of the culms should be selected as the connecting leg for each base to be constructed, as explained above. A partially penetrating second hole may then be drilled at a selected distance from the first penetrating hole, as shown in FIG. 4A. The second hole is preferably drilled through only one wall of the culm that is to serve as the connecting leg. This hole is to receive pin 38, which may be used as a connector as described above. A length of wire which is selected to extend around the circumference and form a supporting member in tension is then cut. A loop may be formed at the end of the wire and the loop soldered and twisted together for strength. The top wire is then threaded through the selected number of culms and the loop attached to the connecting leg with a pin, the pin preferably being made of bronze. This is most easily done by attaching a lead of light wire or monofilament line through the holes of the legs. By pulling the wire loop through with monofilament, the loop is exposed for easy pin installation. A second loop on the other end of the wire is then formed in a similar fashion. The wire is threaded through holes at the selected distance from the center of the culm. When spacers are placed on wire between the culms which serve as legs, the spacers have been cut to a selected length which will essentially fill the space between adjacent legs of the support. To complete the support base, the ends of the support wires are joined. The joining may not be performed until the structure has been shipped to a dealer or user. For shipping, the wire supports are preferably separated at the ends and the structure extended to form a double helix as shown in FIG. 3.

Figure 6:
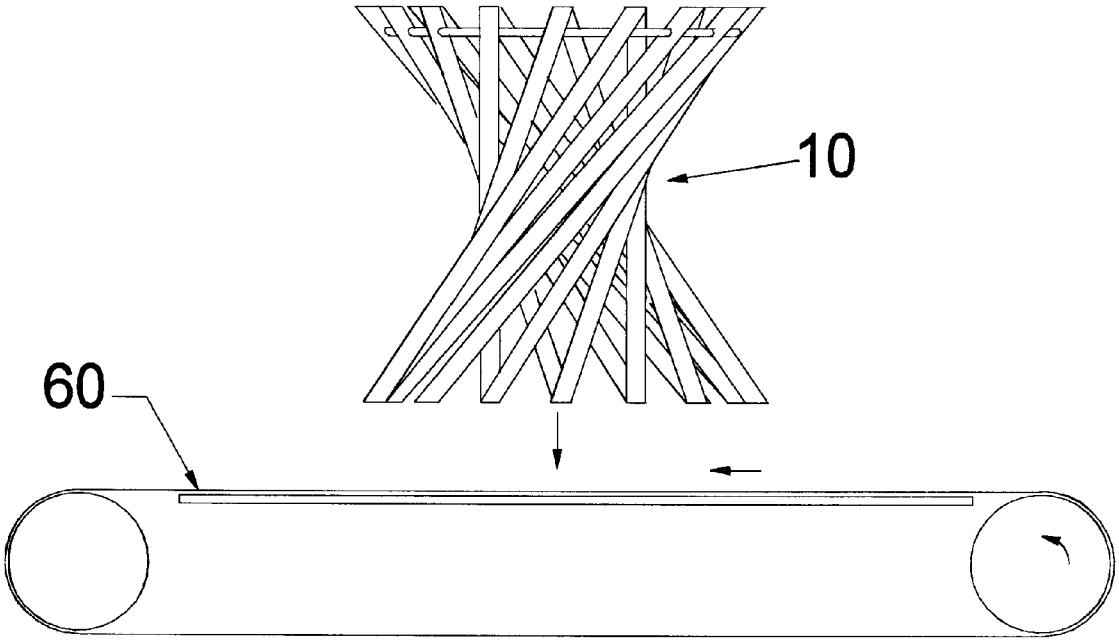
FIG. 6 illustrates a sander used for finishing ends of culms in a horizontal plane.

Minor adjustments on the angles of cuts at the ends of the culms may be made by a large flat plane sander which has an area sufficient to sand all ends simultaneously, as shown in FIG. 6. Support base 10 is placed on wide sanding belt 60 for a time sufficient to insure that all elliptical surfaces are horizontal.

The bamboo may be used in its natural state with very little waste. No bark removal, squaring, or surfacing is required. The helix furniture design provides a support that becomes more rigid and stable as load is applied and the wires are placed in greater tension. The design allows for variations in leg diameters over a wide range. This provides variation in texture between and within individual units, while utilizing a broad range of raw material dimensions. Because the wire or line is flexible and worked only in tension, the helix furniture adjusts to regular floor surfaces without producing a teetering effect.

When the piece remains symmetrical, but the height to diameter changes, the angle of the wire lines and the end cuts change from 45°. The angle decreases (cut more perpendicular to the pole axis) as the height to diameter ratio increases. The angle of the legs can be varied from nearly vertical to nearly horizontal. The practical angles for strength, esthetics and ease of construction cluster around 45°. The axis of the entire support can be varied from vertical, however. This modification produces interesting shapes but requires making cuts and holes at angles which change for each leg. One benefit would be for furniture designed to be used in a specific restricted space or for supporting unusual loads. Each case is preferably drawn to scale with a computer-aided drawing program, which is well known in the art, and angles and dimensions taken off the drawings.

The diameter of the legs can vary from item to item and even within a single product. This may provide a textured look. The location of the wire lines may vary. Normally the top wire also cradles the seat of chairs and stools; hence it is placed near the top of the leg or culm ends. The other wire can be as high as the waist and down as low as practical on the bottom of the end of the culms. In addition to the above variations, the top and bottom (and additional) wires can be made at an angle not perpendicular to the axis of the support as long as at least two wires encircle the entire unit. This may produce an elliptical wire line shape.

Although the present invention has been described with reference to specific details, it is not intended that such details should be regarded as limitations upon the scope of the invention, except as and to the extent that they are included in the accompanying claims.

What is claimed is:

1. A support base, comprising:

at least three bamboo culms, each culm having a selected length and having an end forming an elliptical surface and having holes through the culms in a plane, the holes being located at two or more spaced apart distances from the elliptical surface so as to form a waist when the holes are joined along a line;

a plurality of wire members, each having two ends, adapted for extending through the holes and along the line;

spacers adapted for placement over at least one of the wire members and between the culms; and means for joining the ends of the wire members.

2. The support base of claim 1 wherein the plane is parallel to the elliptical surface.

3. The support base of claim 1 wherein the means for joining the ends is a loop in the ends of the wire member and a rod adapted to extend through the loops.

4. The support base of claim 3 wherein the rod is adapted for entering a second hole in a connecting leg.

5. A method for making a bamboo support base, comprising the steps of:

providing a selected number of bamboo culms, each culm having an axis and two ends, the selected number being greater than two;

forming a first hole through each culm at a selected angle with respect to the axis of the culm;

while supporting each culm in a first plane, cutting the ends at a selected distance from the first hole and at the selected angle with respect to the axis of the culm;

while supporting each culm, moving the axis of the culm through a selected angle θ in a plane passing through the axis and perpendicular to the first plane and forming at least one hole in each culm at a selected distance from an end, the angle θ being selected so as to align the holes along a line at the selected distance from the end;

providing spacers adapted to be placed between the culms when the holes are aligned along the line between the culms;

providing a plurality of wires and placing a wire through the holes in the culms at each selected distance and through the spacers; and connecting the ends of the wires.

6. The method of claim 5 further comprising the step of sanding at least one end of the culms.

7. A method for making a bamboo support base, comprising the steps of:

providing a selected number of bamboo culms, each culm having an axis and two ends, the selected number being greater than two;

while supporting each culm in a first plane, cutting the ends at a selected distance apart and at a selected angle with respect to the axis of the culm;

while supporting each culm, moving the axis of the culm through a selected angle θ in a plane passing through the axis and perpendicular to the first plane and forming a hole in each culm at a selected distance from an end and at an angle θ with respect to the axis, the angle θ being selected so as to align the holes along a line at the selected distance from the end;

providing spacers adapted to be placed between the culms when the holes are aligned along the line between the culms;

providing a plurality of wires and placing a wire through the holes in the culms at each selected distance and through the spacers; and connecting the ends of the wires.

* * * * *